United States Patent [19]

Bishop, Jr.

[11] 4,291,426

[45] Sep. 29, 1981

[54] COMBINATION SOCKET WRENCH AND GAUGE

[76] Inventor: Walter S. Bishop, Jr., 7300 Wild Onion, Austin, Tex. 78744

[21] Appl. No.: 148,515

[22] Filed: May 9, 1980

[51] Int. Cl.[3] ..... B25F 1/00

[52] U.S. Cl. ..... 7/100; 7/164; 33/168 R

[58] Field of Search ..... 7/100, 164, 169, 170; 33/168 R

[56] References Cited

U.S. PATENT DOCUMENTS

| | | | |
|---|---|---|---|
| 2,184,340 | 12/1939 | Ferlin | 7/100 X |
| 2,313,174 | 3/1943 | Shock | 7/100 |
| 2,564,812 | 8/1951 | McGuire | 7/100 X |
| 2,578,975 | 12/1951 | Horne | 33/168 R |
| 2,664,638 | 1/1954 | Storey | 33/168 R |
| 2,693,124 | 11/1954 | Rozankowski | 81/90 |
| 2,869,160 | 1/1959 | Murcott | 15/105 |
| 3,045,354 | 7/1962 | Frauenholtz | 33/168 R |
| 3,680,159 | 8/1972 | Wharram | 7/100 |

*Primary Examiner*—James G. Smith

*Attorney, Agent, or Firm*—Roylance, Abrams, Berdo & Farley

[57] ABSTRACT

A combined socket wrench and gauge for removing, installing and setting the gap of spark plugs includes an elongated tubular body with a socket in one end and an annular gauge wall extending axially from the other end. The gauge wall has a series of flat gauge members in edge-to-edge relationship, forming a polygon of gauges of predetermined thicknesses. The distal edge of each gauge is beveled. The gauge sizes are stamped into the outside body surface.

5 Claims, 6 Drawing Figures

COMBINATION SOCKET WRENCH AND GAUGE

This invention relates to a combination tool and gauge and, more specifically to a socket type wrench for setting the gap of and removing or installing spark plugs.

BACKGROUND OF THE INVENTION

When a spark plug is initially being installed in an internal combustion engine, it is usually necessary to set the gap between electrodes and it is always desirable to check the setting. The same is true when a plug is being removed, cleaned or checked, and replaced.

Normally, two tools are required for these tasks, apart from any devices for cleaning the spark plug. One tool is a wrench for removing the plug and for reinstalling it, commonly a socket type of wrench of a size suitable to a class of spark plugs, and the other tool is a gauge, or set of gauges, for establishing the proper gap setting, depending upon the nature of the engine and its intended operating condition, and on the type of plug.

It has been recognized that considerable convenience would result from the development of a tool having the socket wrench and gauge combined, but the efforts in that direction have not been fully satisfactory. Examples of the prior art are found in the following patents.

U.S. Pat. Nos. 2,184,340; D. E. Ferlin
2,313,174; F. C. Shock
2,564,812; C. McGuire
2,578,975; J. H. Horne
2,693,124; L. J. Rozankowski
2,869,160; C. E. Murcott
3,680,159; Wharram.

In most of these references the tools and gauges are designed for use with articles other than spark plugs and the wrenches shown are simply not suitable for installing or removing plugs. In Wharram, the wrench of which is designed for use with spark plugs, a thickness gauge of a single thickness dimension is attached to or formed as a part of, a handle attached to a socket. Not only is this gauge capable of only measuring one thickness or gap width, but the manner of attaching the gauge to the handle has several disadvantages including the fact that the gauge and handle must be removed from the socket so that the socket can be used in some of the more modern automobile engines in which lateral access to a plug is often limited. This means that the gauge can easily be misplaced.

BRIEF DESCRIPTION OF THE INVENTION

It is an object of the present invention to provide a socket wrench, particularly for use with spark plugs, having a plurality of thickness gauges affixed thereto.

A further object is to provide a wrench having a socket for engaging a spark plug at one end and, at the other end a segmented, generally annular wall forming a series of gauges of different thicknesses.

Yet another object is to provide such a wrench wherein the exposed distal edges of the gauges are beveled.

Briefly described the invention includes a combined spark plug wrench and gauge apparatus comprising a generally tubular body, means at one end of said body defining a polygonal socket for engaging and rotating the body of a spark plug, and a plurality of plate-like members fixedly attached to and protruding axially from the other end of said body, said members having predetermined different thicknesses for checking and setting the gap between electrodes of the spark plug.

In order that the manner in which the foregoing and other objects are attained in accordance with the invention can be understood in detail, particularly advantageous embodiments thereof will be described with reference to the accompanying drawings, which form a part of this specification and wherein.

Figure 2:
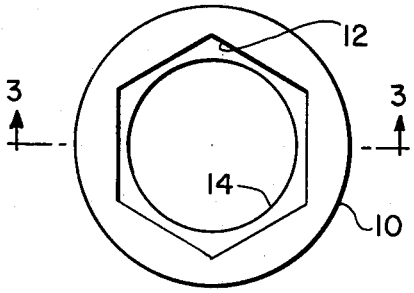
FIG. 2 is a bottom plan view of the apparatus of FIG. 1.

As seen in the figures, the apparatus includes a generally tubular body 10 having a cylindrical outer surface. The body is preferably made of hardened steel alloy and can be provided with a chrome plated finish to inhibit corrosion. The interior of the body is hollow, the major portion of the body having a cavity 11. At one end, the lower end in FIGS. 1 and 3 the body is provided with a polygonal socket cavity 12 opening to the end, the cavity being hexagonal in shape and dimensioned to engage the hexagonal shoulder conventionally provided on a spark plug for installation and removal thereof. An annular, inwardly extending shoulder 14 is formed on the interior of the body to generally follow the contour of the spark plug.

As will be recognized, the structure described thus far is generally similar to a conventional socket wrench, the cavity 11 being axially elongated enough to accomodate the ceramic insulator and end connector portions of the spark plug. In the embodiment shown, the end opposite the hexagonal socket 12 is provided with a square opening 16 to receive the square drive stud of a drive tool. Opening 16 can be provided with recesses 17 to accomodate detent balls which are frequently provided on drive studs for this purpose. Alternatively, the body can be provided with aligned openings along a diameter of the body to permit a rod or pin to be passed therethrough for rotating the socket during installation and removal of the plug.

Figure 4:
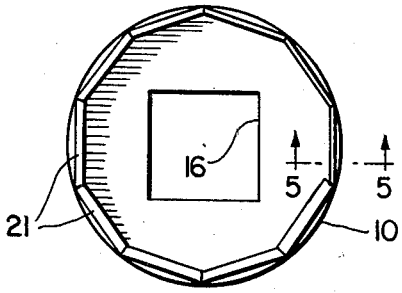
FIG. 4 is a top plan view of the apparatus of FIGS. 1–3.
Figure 1:
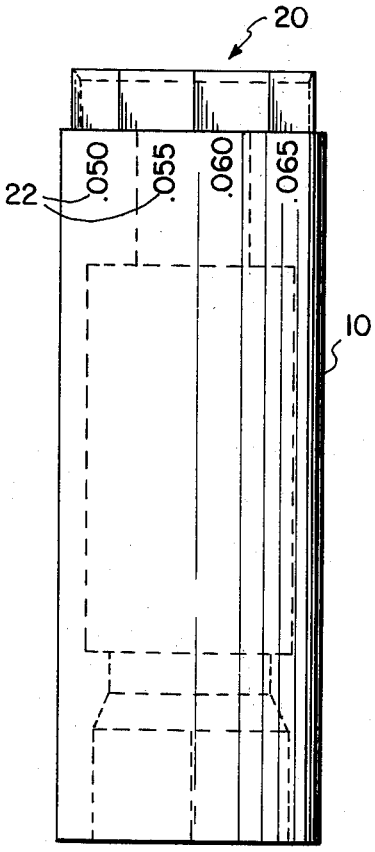
FIG. 1 is a side elevation of an apparatus in accordance with the invention.
Figure 3:
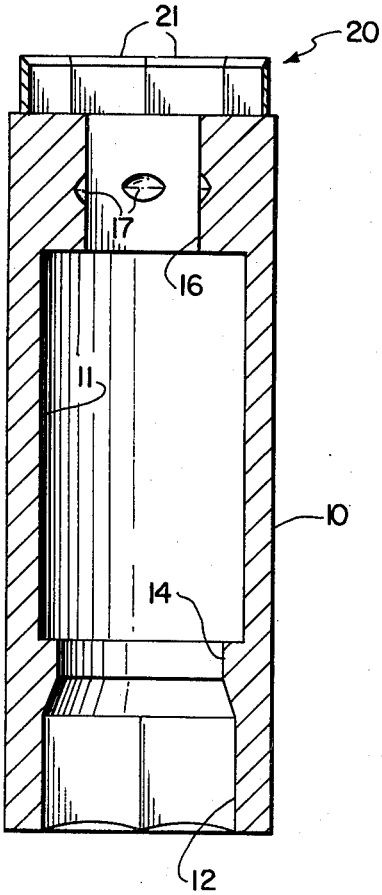
FIG. 3 is a side elevation of the apparatus of FIGS. 1 and 2 in section along line 3—3 of FIG. 2.

At the upper end of the body, as seen in FIGS. 1 and 3, there is provided a gauge structure indicated generally at 20, the gauge comprising a plurality of plate-like gauge members 21 which portrude axially from the end of the body around opening 16. Each gauge member is a flat, generally rectangular segment, the members being arranged in contiguous side-by-side relationship to form a generally annular wall. Each segment has a predetermined thickness and, as seen in FIG. 4, the thicknesses of the segments are different from each other, thereby providing an array of different thicknesses for checking and setting the gap between electrodes of a spark plug in accordance with the requirements of the plug and of the engine with which it is used. The segments can conveniently be provided in varying thicknesses differing from each other by 0.005 inches and can occupy a range of, for example 0.020 inches to 0.065 inches in an arrangement such as that shown wherein ten segments are provided.

The outer surface of body 10 is further provided with indicia as shown at 22 in FIG. 1, the indicia being stamped or otherwise formed in the exterior surface and in radial alignment with the segments to identify the thickness of each segment. Thus, it will be readily apparent to the user which segment should be employed to set a spark plug gap under known circumstances.

Figure 5:
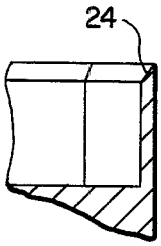
FIG. 5 is an enlarged framentary sectional view along line 5—5 of FIG. 4.

In addition, each segment is provided with a beveled upper edge 24 as best seen in FIG. 5. This beveled edge facilitates entry of the selected segment into the gap between spark plug electrodes to facilitate gentle separation thereof without damage to the plug structure.

The segments 21 can be formed by casting the tubular body with the segments attached, followed by grinding of the individual segments to the desired thicknesses. Alternatively, the segments can be separately formed and ground to the desired thicknesses and can be subsequently attached, as by welding, to the end of the socket.

Figure 6:
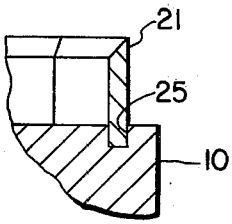
FIG. 6 is a view, similar to FIG. 5, of an alternative embodiment.

A further alternative construction technique is illustrated in FIG. 6 wherein the body 10 is formed with an annular groove 25 in the end face thereof around opening 16, the separately formed segments 21 being inserted into the groove and held therein by compressing the region of the groove from the outside or by using a separate fastener passing therethrough.

As will be recognized, the tool thus described allows the person using it to adjust the spark plug electrode gap using the gauges which are conveniently provided on the top of the tool. The beveling of the segment edges expedites setting of the gap, and the provision of the segments on the tool itself prevents separation of the gauges from the tool and misplacement of one or the other.

While certain advantageous embodiments have been choosen to illustrate the invention it will be understood by those skilled in the art that various changes and modifications can be made therein without departing from the scope of the invention as defined in the appended claims.

What is claimed is:

1. A combined spark plug wrench and gauge apparatus comprising a generally tubular body;

means at one end of said body defining a polygonal socket cavity for engaging and rotating the body of a spark plug; and a plurality of plate-like members fixedly attached to and protruding axially from the other end of said body, said members having predetermined different thicknesses for checking and setting the gap between electrodes of the spark plug.

2. An apparatus according to claim 1 wherein said plurality of plate-like members are arranged in edge-to-edge relationship forming a substantially continuous, generally annular wall.

3. An apparatus according to claim 2 wherein each of said plate-like members is flat and wherein the distal edge of each member is beveled to facilitate insertion in the gap between the electrodes.

4. An apparatus according to claim 3 wherein said body includes indicia means on an exterior surface of the body generally radially aligned with each of said members identifying the thickness of the associated member.

5. An apparatus according to any of claims 1–4 wherein said body includes means defining an axial opening in said other end to receive the drive stud of a wrench handle.

* * * * *